US005389201A

United States Patent [19]

Tsai

[11] Patent Number: 5,389,201

[45] Date of Patent: Feb. 14, 1995

[54] BLEACHING OF KRAFT CELLULOSIC PULP EMPLOYING OZONE AND REDUCED CONSUMPTION OF CHLORINE CONTAINING BLEACHING AGENT

[75] Inventor: Ted Y. Tsai, Harriman, N.Y.

[73] Assignee: International Paper Company, Purchase, N.Y.

[21] Appl. No.: 137,732

[22] Filed: Oct. 18, 1993

Related U.S. Application Data

[63] Continuation of Ser. No. 843,843, Feb. 28, 1992, abandoned.

[51] Int. Cl.[6] ..... D21C 9/12; D21C 9/147; D21C 9/153

[52] U.S. Cl. ..... 162/57; 162/65; 162/89

[58] Field of Search ..... 162/57, 65, 66, 67, 162/88, 89

[56] References Cited

U.S. PATENT DOCUMENTS

| | | | |
|---|---|---|---|
| 2,466,633 | 4/1949 | Brabender et al. | 162/65 |
| 4,278,496 | 7/1981 | Fritzvold | 162/65 |
| 4,372,812 | 2/1983 | Phillips et al. | 162/65 |
| 4,959,124 | 9/1990 | Tsai | 162/89 |

FOREIGN PATENT DOCUMENTS

| | | | |
|---|---|---|---|
| 53-90402 | 8/1978 | Japan . | |
| 53-90403 | 8/1978 | Japan . | |
| 54-30902 | 3/1979 | Japan | 162/65 |

OTHER PUBLICATIONS

Degradation of Residual Lignin In Kraft Pulp With Ozone; Application to Bleaching: D. Lachenal and M. Muguet, 6th International Symposium of Wood and Pulping Conference; Apr. 28, 1991.

H. Sixta, G. Gotzinger, A. Schrittwieser and P. Hendel, Medium Consistency Ozone Bleaching: Laboratory and Mill Experience 45 Jahrgang. Heft 10.1991.

Perkins "Advances In Ozone Bleaching, Part III"; pp. 263–266.

*Primary Examiner*—Steve Alvo

*Attorney, Agent, or Firm*—Luedeka, Neely & Graham

[57] ABSTRACT

In a multi-stage bleaching sequence for kraft pulps employing a chlorine-containing bleaching agent in the first and final stages thereof and an intermediate alkaline extraction stage, the improvement for enhancing the brightness of the pulp and reducing the quantity of dioxin or chlorinated organics comprising contacting the pulp, in a mixer, at an acidic pH and a temperature of below about 60° C. with a mixture of ozone and oxygen at a pressure of between about 60 and 80 psig wherein the quantity of ozone introduced to the pulp is between about 0.2% and about 0.4%, based on pulp.

18 Claims, 6 Drawing Sheets

ZERO-SPAN VERSUS PULP FREENESS FOR D(zEo+p)D AND D→CdEo+pD PULPS

TEAR FACTOR VERSUS BREAKING LENGTH FOR D(zEo+p)D AND D→CdEo+pD PULPS

TEAR FACTOR VERSUS PULP FREENESS FOR D(zEo+p)D AND D→CdEo+pD PULPS

BREAKING LENGTH VERSUS PULP FREENESS FOR D(zEo+p)D AND D→CdEo+pD PULPS

BURST FACTOR VERSUS PULP FREENESS FOR D(zEo+p)D AND D→CdEo+pD PULPS

DOUBLE FOLDING VERSUS PULP FREENESS FOR D(zEo+p)D AND D→CdEo+pD PULPS

PULP OPACITY VERSUS PULP FREENESS FOR D(zEo+p)D AND D→CdEo+pD PULPS

PULP FREENESS VERSUS PFI REVOLUTIONS FOR D(zEo+p)D AND D→CdEo+pD PULPS

BLEACHING OF KRAFT CELLULOSIC PULP EMPLOYING OZONE AND REDUCED CONSUMPTION OF CHLORINE CONTAINING BLEACHING AGENT

This is a continuation of U.S. patent application Ser. No. 07/843,843, filed Feb. 28, 1992, now abandoned.

This invention relates to the bleaching of kraft cellulosic pulps and particularly to an improvement in the conventional process for the bleaching of these pulps, this conventional process comprising contacting the pulp with a chlorine-containing bleaching agent in first and final stages of the bleaching process and including an intermediate alkaline extraction stage which is enhanced with oxygen and/or peroxide.

Chlorine-containing bleaching agents for kraft cellulosic pulps currently represent the most effective of the many known bleaching agents for this use. Chlorine and chlorine dioxide are the most commonly employed forms of the chlorine-containing bleaching agents. Both these bleaching agents, however, are known to contribute to the ultimate generation of dioxins, chlorinated phenolics, and other environmentally undesirable compounds in the effluent from the bleaching operation, in the pulp and finally in the paper product produced from the bleached pulp. This problem is present in the conventional CED; D→CED; D→CDED and like bleaching sequences. Nonetheless, these sequences remain among the most effective bleaching sequences for kraft pulps and are widely used. In these prior art bleaching sequences, the pulp is of a low consistency, e.g. 1–15%, on pulp, during at least the initial chlorination stage. One effort to reduce the generation of undesirable chemical moieties in the effluent and pulp, hence in the paper product, of these prior art bleaching sequences is described in U.S. Pat. No. 4,959,124, issued to the present inventor and which discloses a DZED bleaching sequence in which there is reduced total chlorine content of the bleached pulp, and a reduction in adsorbable organic halogens (AOX). Other attempts toward reduction of the undesirable chemical moieties have been to reduce the total quantity of chlorine available for reaction with those components of the pulp which, when combined with the chlorine, become environmentally undesirable or lead eventually to such undesirable moieties. One concern when reducing the actual quantity of chlorine-containing bleaching agents is the cost effect associated with the necessary process changes required to replace the loss of bleaching power of the chlorine and still obtain the desired target pulp brightness. The cost effect may involve the plant equipment and/or the bleaching agents used as substitutes for the chlorine.

In the prior art, the quantity of ozone which can be added to the pulp in a bleaching process is limited to a maximum of about 15 psig over time since this is the maximum pressure obtainable by the conventional ozone generator. Many existing mills do not have the equipment required for handling ozone or oxygen at 15 psig. This limitation means that the maximum percentage ozone that can be added to the pulp can be no more than about 0.1% on pulp, because the ozone actually is a mixture of ozone in oxygen, with the ozone representing less than 10% by weight of the mixture.

It is much desired, therefore, that there be made available a bleaching process in which the chlorine-containing bleaching agents may be retained so as to gain the advantages which they represent, and simultaneously there be an acceptable reduction in the generation of environmentally undesirable chemical moieties, such as dioxins, etc.

In accordance with the present invention, there is provided an improved bleaching process in which the first and final stages of the bleaching sequence comprise contacting the pulp with a chlorine-containing bleaching agent so that the advantages of these bleaching agents is retained. The present process further contemplates the use of an oxygen-enhanced alkaline extraction stage as an intermediate stage between the first and final stages of the sequence as is taught in the prior art. Unexpectedly, the present inventor has discovered that dramatic and material reduction of the quantity of the chlorine-containing bleaching agent employed in at least the final stage of the sequence may be achieved, while still attaining a desired high target brightness of the pulp and while materially reducing the generation of environmentally undesirable chemical compounds, by adjusting the consistency of the pulp exiting from the first chlorination stage (which is acidic) to between about 11% and 45%, preferably 11% to 35%, based on oven dried pulp weight, and contacting the pulp of adjusted consistency, in a mixer, with between about 0.2% and 0.5% ozone, based on oven dried pulp weight, in a mixture of ozone and oxygen at a pressure of between about 60 and 100 psig in which the ozone represents between about 5% and about 10% by volume of the mixture, and thereafter processing the ozone-treated pulp through the oxygen-enhanced alkaline extraction stage and then through the final bleaching stage. Employing the present process, the inventor has found that the quantity of available chlorine in the final chlorination stage may be reduced by about 13% relative to that amount of available chlorine required in the known prior art processes. At current prices, this usage of ozone and concomitant reduction in usage of available chlorine represents substantially an even tradeoff from the standpoint of raw material costs, but the resultant advantages in reduction of undesirable compounds in the bleaching effluent, the pulp and the paper product are great. Importantly, the present process may be implemented in a mill by the addition of a mixer and compressor to the prior art bleaching equipment, or as required two mixers, in which the ozone at a pressure of between about 60 and 80 psig is added to and intimately mixed with the pulp.

It is therefore an object of the present invention to provide an improved process for the bleaching of kraft cellulosic pulps which produces pulp of desired target brightness with accompanying reduction in the generation of environmentally undesirable chemical moieties.

It is a another object of the present invention to provide an improved bleaching process which maximizes the use of ozone in combination with chlorine-containing bleaching agents to effect a reduction in the total required quantity of the chlorine-containing bleaching agents relative to the quantities heretofore required by prior art bleaching processes that employ chlorine-containing bleaching agents.

Other objects and advantages of the present invention will be recognized from the following description and claims, including the drawings in which:

Figure 1:
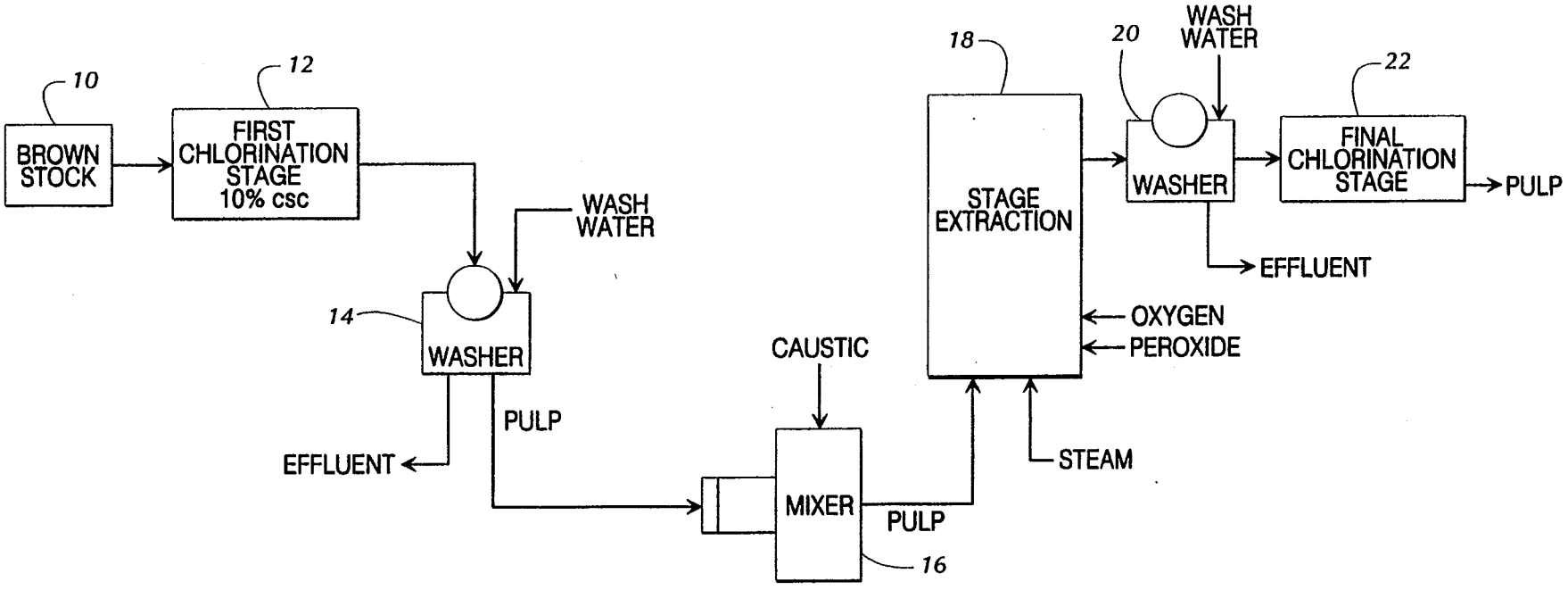
(PRIOR ART) FIG. 1
FIG. 1 is a schematic representation of a prior art CED bleaching process.

With reference to FIG. 1, in a prior art bleaching process employing a CED bleaching sequence that typifies a conventional chlorination-extraction-chlorination bleaching process, pulp (brown stock) at a pH of about 3 and at a consistency of between about 1 and 10%, on pulp, from a storage vessel 10 is conveyed to a first chlorination stage 12 wherein the pulp is contacted with chlorine, chlorine dioxide, or a combination thereof. Following this first chlorination stage, the pulp preferably is washed with water in a washer 14. The effluent from the washer is conveyed to an effluent collection or treatment location and the washed pulp at a consistency of about 30%, for example, is conveyed to a mixer 16 wherein there is added caustic, e.g. sodium hydroxide, to adjust the pH of the pulp to about 11. From the mixer 16, the pulp is fed to an extraction stage tower 18. Following a time of residence in an extraction tower 18, the pulp is fed to a further washer 20 where the pulp is washed with water, the effluent from the washer being conveyed to storage or treatment and the washed pulp being conveyed to a second and final bleaching stage 22 wherein the pulp at a consistency of between about 1 and 10%, on pulp, is contacted with a chlorination agent. The bleached pulp is collected for subsequent use.

Figure 2:
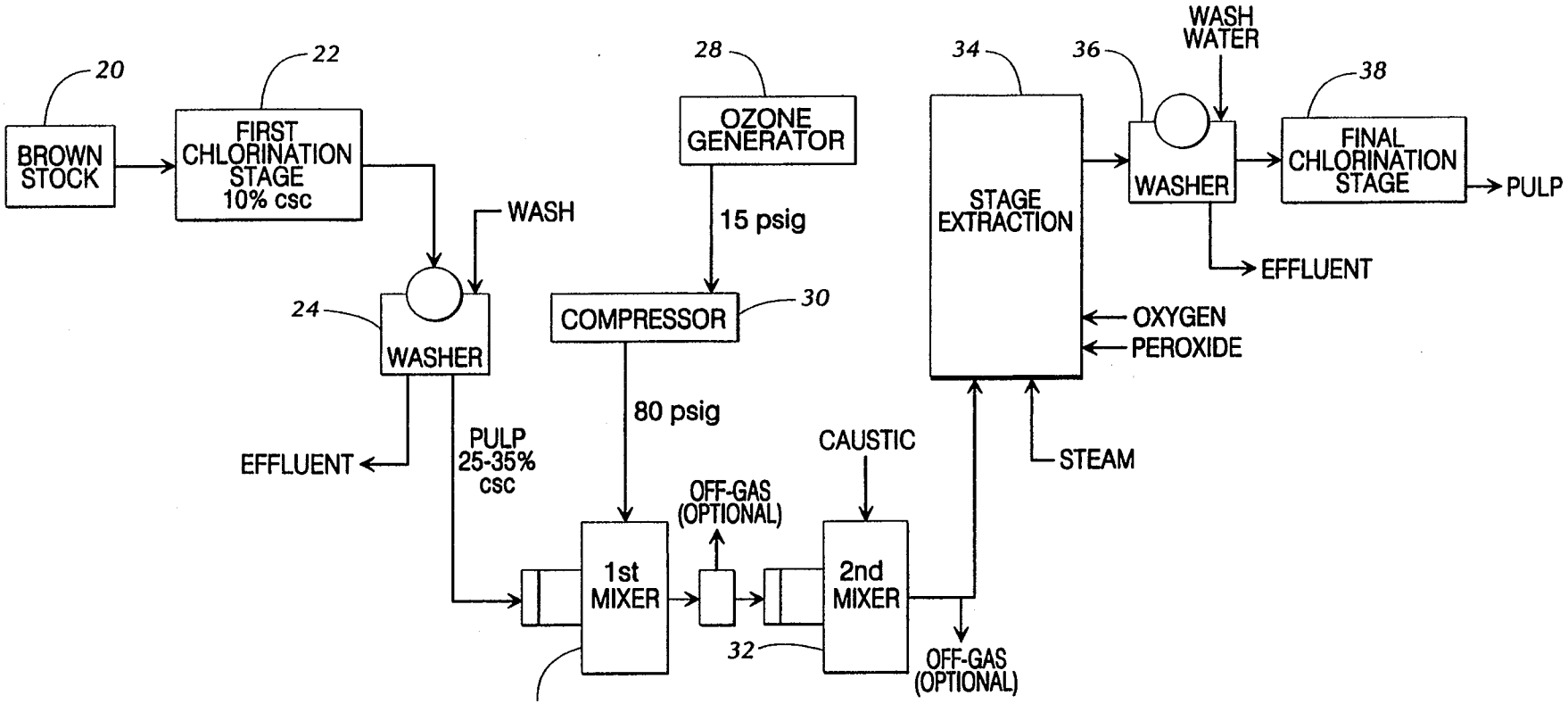
FIG. 2 is a schematic representation of a bleaching process for kraft cellulosic pulp and embodying various of the features of the present invention.

Referring to FIG. 2, in one embodiment of the present invention, a quantity of kraft cellulosic pulp is fed from a digester or storage chest 20 to a first chlorination stage 22 where the pulp is contacted with chlorine dioxide or chlorine or a combination thereof, preferably chlorine dioxide. The chlorinated pulp is fed to a washer 24 where the pulp is washed with either fresh water or other wash liquid. The effluent from the washer is sewered or conveyed to an effluent treatment facility while the washed pulp is conveyed to a first mixer 26. In the mixer 26, ozone from a conventional ozone generator 28 and which has been pressurized by a compressor 30 to between about 60 and about 100 psig, is introduced into the pulp. The temperature of the pulp within the mixer 26 is maintained at a value, e.g. about 20° C., at which the ozone, in the acidic pulp, will react with components of the pulp such that during the time of residence of the pulp within the first mixer, the ozone is consumed through chemical reaction. The temperature of the pulp in the first mixer 26, however, is not sufficiently high as will permit the oxygen in the ozone mixture to react with components of the pulp. Following reaction of the pulp and ozone in the first mixer 26, the pulp, containing oxygen, is conveyed to a second mixer 32. In this second mixer 32, the pH of the pulp is adjusted, as by the addition of caustic, to an alkaline state. The alkaline pulp is fed from the second mixer to an extraction stage, which may take the form of a reaction tower 34. Within the mixer 32, there may be added to the pulp oxygen which is in addition to that oxygen which is residual from the ozonation step. In a preferred embodiment, peroxide, such as hydrogen peroxide, is also added to the pulp in the mixer 32. Through the introduction of steam or by other heating means, either in the second mixer or in the reaction tower, the temperature of the pulp in the extraction stage is established at a level where the oxygen and peroxide in the pulp will react with components of the pulp. The time of residence of the pulp in the extraction stage is chosen to permit substantially complete reaction of the oxygen and peroxide with components of the pulp, whereupon the pulp is conveyed to a second washer 36 where the pulp is washed and then fed forwardly to a final bleaching stage 38. The effluent from the washer 36 is either sewered, reused or conveyed to an effluent collection or treatment facility. Following the final bleaching stage, the pulp is conveyed to a storage or use location, preferably after being again washed (wash step not shown in FIG. 2). Further, whereas there is depicted and described a single mixer 26 for use in the addition of the ozone to the pulp, it is to be recognized that two, or more, mixers may be employed, either to merely divide the task of adding the ozone or to permit even greater percentages of ozone to be added to the pulp. The pulp may be off-gassed as required to adjust the quantity of oxygen in the pulp.

The process of the present invention and a prior art process which currently is used extensively in paper-making mills, namely a $D \rightarrow C_dE_{o+p}D$ bleaching sequence, were used to demonstrate the benefits of the present invention. Specifically, southern pine kraft pulp having a Kappa No. of 27.9 and a viscosity of 42 cP was used in the study. The pulp was spiked with a 1.5% screen-room reject which is retained between 10 and 15-cut (one cut equals one thousandth of an inch) flat screen. The bleaching conditions of the study are given in Table I.

TABLE I

BLEACHING CONDITIONS AND RESULTS FOR D(zEo + p)D AND CONTROL (D → (dEo + p)D

| Bleaching Sequences | Chemical Charges | | | | Brightness (%) GE | Viscosity (cP) | Effluent (kg/TP) AOX | COD | Color |
|---|---|---|---|---|---|---|---|---|---|
| | D → Cd | | Eo + p | D | | | | | |
| D → CdEo + pD | 0.86% → 2.51% + 0.1% | | 3.2% NaOH 0.6% $H_2O_2$ | 0.7% | 85.9 (81.1) | 26.8 | 3.12 | 64.6 | 122.4 |
| | D | Z | Eo + p | D | | | | | |
| D(zEo + p)D | 1.92% | 0.248% | 3.2% NaOH 0.6% $H_2O_2$ | 0.4% | 84.3 (80.1) | 19.6 | 1.27 | 66.0 | 97.2 |

In the chlorination stage (D or $D \rightarrow C_d$), the pulp at 50° C. and 10% consistency (csc), on pulp, was contacted with the chlorinating agent for 45 min. in a reaction vessel. The quantity of chlorinating agent was chosen to provide a chlorination factor of 0.18 for the process of the present invention while a chlorination factor of 0.16 or 0.17 was chosen for use with the prior art process. In the prior art process, the chlorine (C) was substituted with 50% chlorine dioxide.

In the first mixer, the consistency of the pulp was adjusted to between 30 and 35%, on pulp. This adjusted consistency pulp, at room temperature (about 20° C.) had added thereto a 0.25% ozone charge, on pulp. This charge was a mixture of oxygen (90%) and ozone (10% by weight) pressurized to 80 psig. At room temperature the ozone reacted with components of the pulp preferentially to the oxygen. Following treatment of the pulp with the ozone, the pulp was diluted with fresh water to a consistency of 10.5%, adjusted in pH to 11 by the addition of 3.2% sodium hydroxide, on pulp, and adjusted in temperature to 70° C. The alkaline and heated pulp was introduced into a Quantum reactor to which there was added 0.6% hydrogen peroxide, on pulp. The pulp was maintained in the reactor for 1 hour. Oxygen at 45 psig was introduced to the reactor and gradually reduced to zero psig over the 1 hour residence period of the pulp within the reactor.

The pulp exiting from the Quantum reactor was washed with fresh water and then introduced, at 10% consistency and at a temperature of 70° C., to a final bleaching stage where a charge of 0.7%, on pulp, of chlorine dioxide was added in the case of the prior art process, and a charge of 0.4%, on pulp, of chlorine dioxide was added in the case of the present inventive process. The pulp was held in the final chlorination stage for 3 hours and sodium hydroxide was added as needed to maintain optimum final pH.

The pulp from the final chlorination stage was formed into handsheets. Pulp brightness, viscosity, and other physical properties of the handsheets were determined by the applicable TAPPI Method. Effluent AOX, COD, and color were determined according to the EPA Method. Chlorinated phenolics were determined according to NCASI Technical Bulletin No. 498 "Methods for the Analysis of Chlorinated Phenolics in Pulp Industry Wastewaters". The results of certain of these tests are given in Table II and plotted in FIGS. 3 through 10 which provide a comparison of several of the tested properties of the handsheets made from the pulps treated by the present process and by the prior art process.

Figure 10:
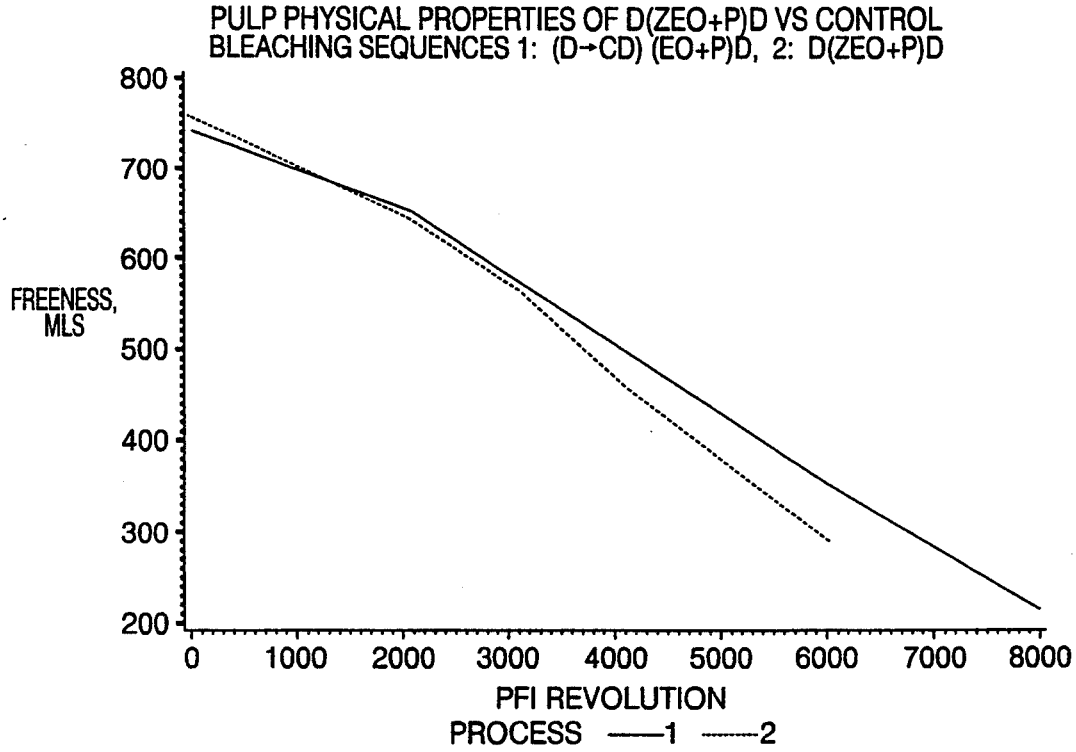

From Table I it will be seen that the quantity of chlorine-containing bleaching agent required by the present process, employing ozone, to achieve substantially equivalent brightness to that obtained using the prior art process was approximately one-half the quantity required in the prior art process which does not use ozone. Further the present process also generated approximately half as much AOX and materially less color in the effluent than did the prior art process. The "dirt" counts and "speck" counts for the pulp treated in accordance with the present process, as shown in Table II, were approximately one-third less than the like counts of pulps produced by the prior art process thereby attesting to the improved ability of the present process to achieve enhanced brightness even in the presence of heavily contaminated pulp. FIG. 10 also shows that the pulp produced by the present process was slightly easier to beat.

Figure 3:
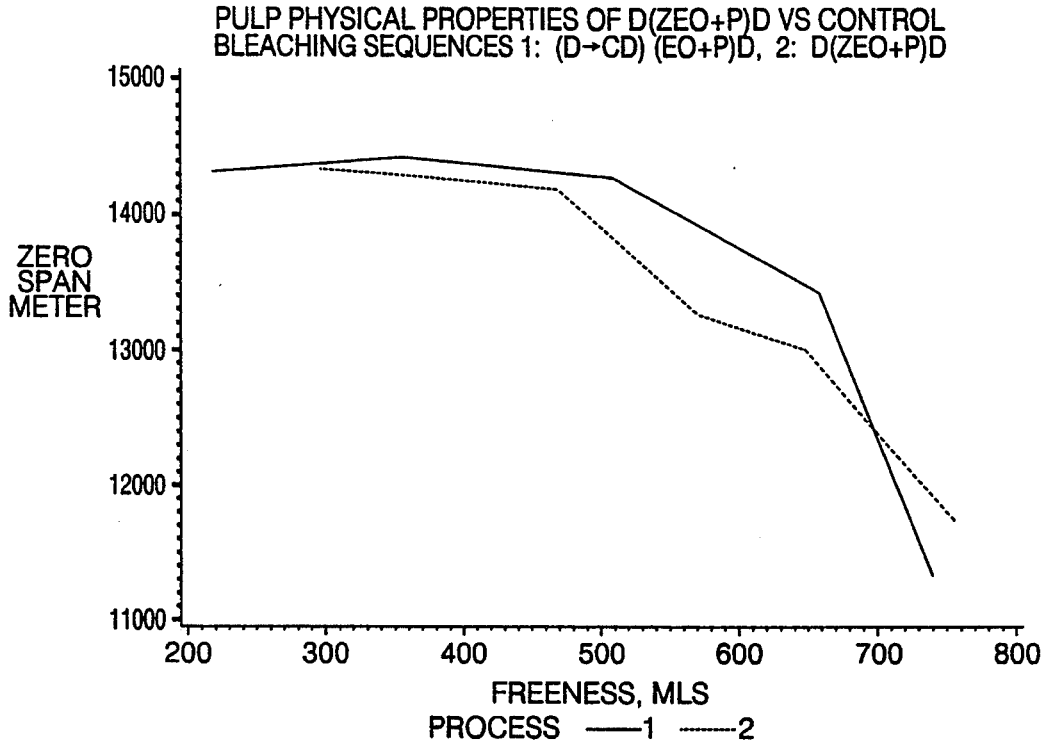
FIGS. 3–10 are graphs which depict various physical properties of handsheets prepared by the present process with handsheets prepared by a prior art process.
Figure 4:
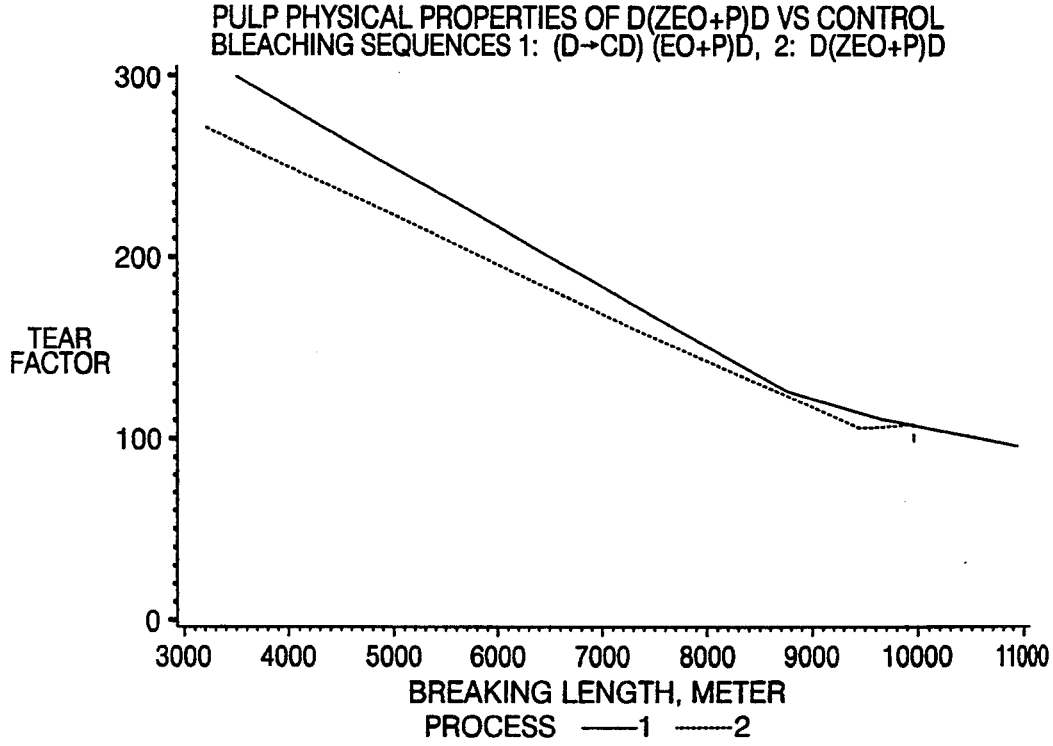
Figure 5:
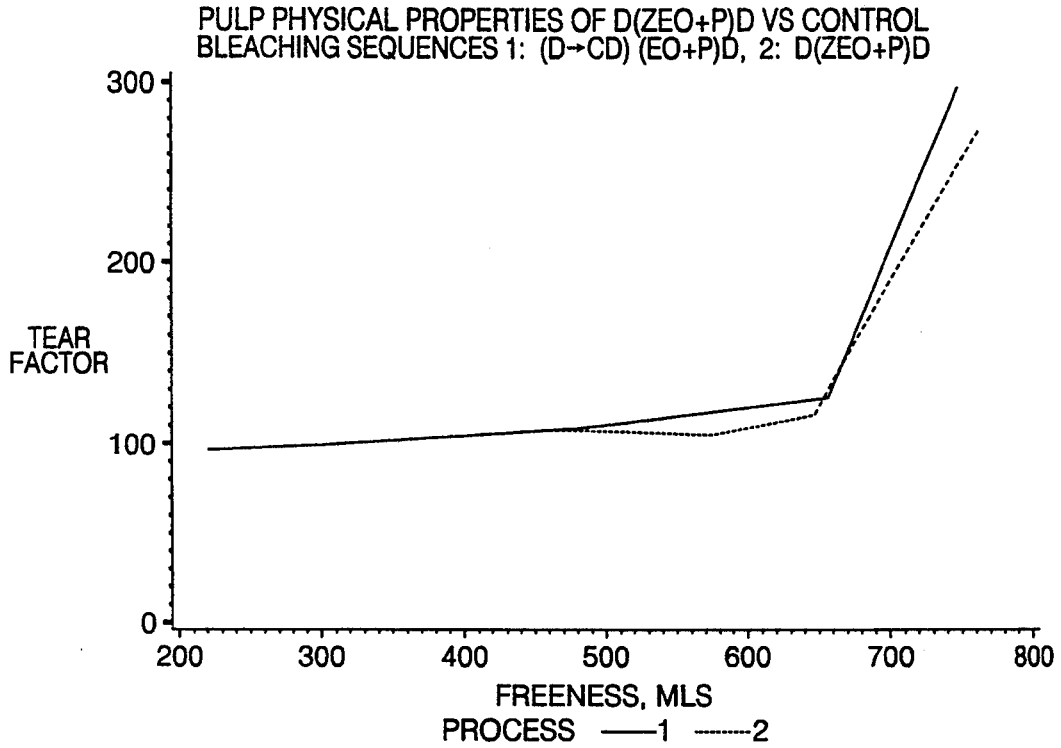
Figure 6:
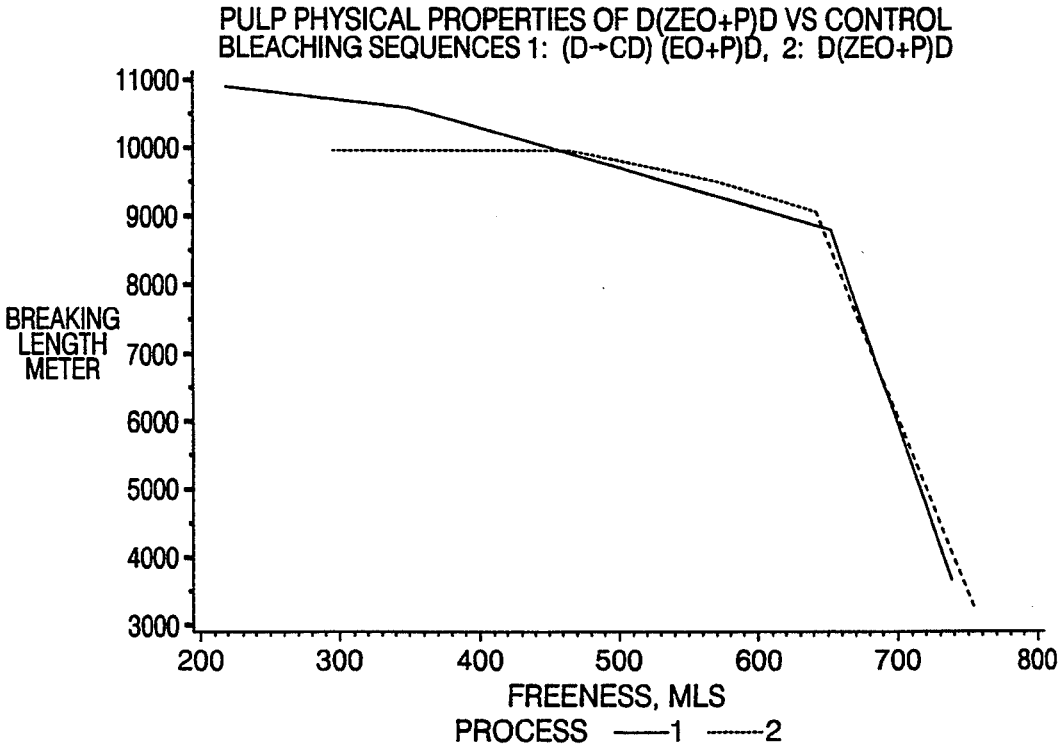
Figure 7:
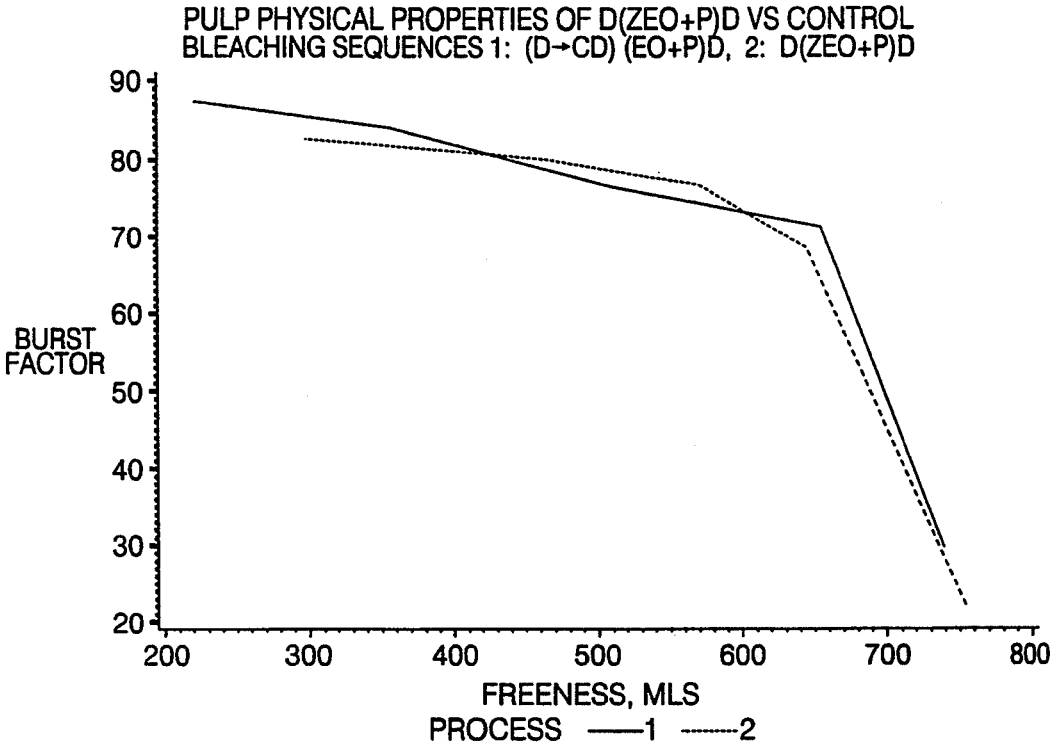
Figure 8:
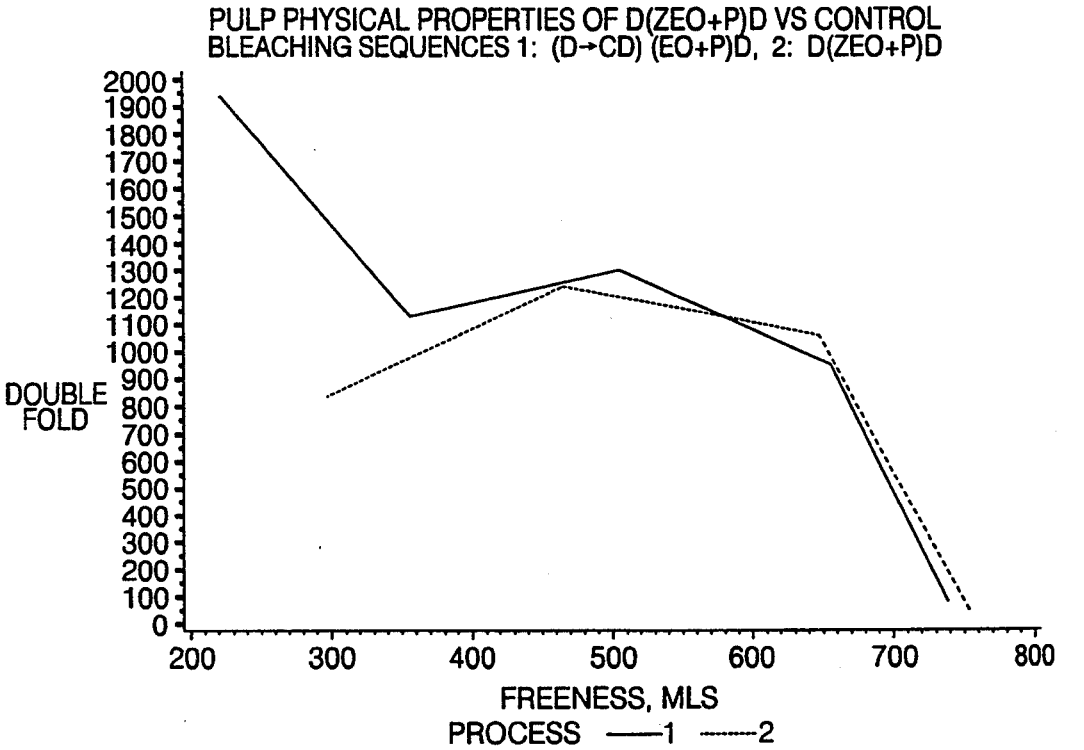
Figure 9:
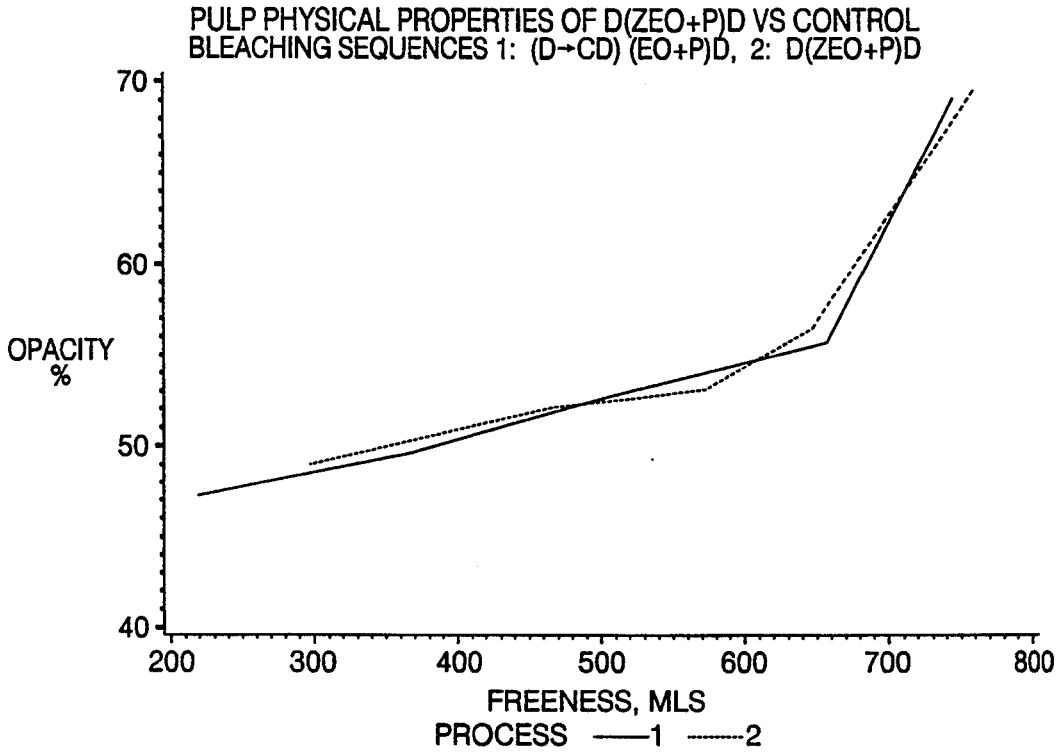

The graphs of FIGS. 3 through 10 show that although the pulp of the present process exhibited a somewhat lower viscosity than the pulp produced by the prior art process, 19.6 cP versus 26.8 cP, no significant differences appeared in the physical properties, such as opacity, folding, burst, tensile and tear strengths (FIGS. 5–9). Similar tear (at 8000–9000 km breaking length) was also noted (FIG. 4). Slightly lower zero-span strength was noted for the pulp of the present process (FIG. 3).

Table III lists the chlorinated phenolics content of the pulps prepared by the present process and by the prior art process. There were significantly fewer chlorinated phenolics produced by the present process due in part to the use of ozone plus the lowered requirement for the chlorination agent.

TABLE II

RELATIONSHIP OF FINAL PULP BRIGHTNESS AND DIRT COUNT ANALYSIS FOR D(zEo + p)D AND D → CdEo + pD PROCESSES

| Bleaching Sequences | Brightness (% GE) | Optical Properties L | a | b | Viscosity (cP) | Dirt ($mm^2/m^2$) | No. of Specks ($\#/m^2$ |
|---|---|---|---|---|---|---|---|
| $D \rightarrow C_dE_{o+p}D$ | 72.3 (68.6) | 93.32 | +0.10 | 10.58 | 29.3 | 1190 | 5527 |
| | 75.7 (70.5) | 94.99 | −0.37 | 9.69 | 26.9 | 1367 | 4617 |
| | 79.5 (75.3) | 95.80 | −0.56 | 8.02 | 29.6 | 457 | 2934 |
| | 82.0 (77.4) | 96.66 | −0.69 | 6.77 | 27.1 | 427 | 1843 |
| | 82.5 (78.5) | 96.90 | −0.90 | 6.48 | 26.8 | 329 | 3655 |
| | 83.2 (78.5) | 96.80 | −0.64 | 6.27 | 29.3 | 111 | 1332 |
| | 84.6 (81.0) | 96.78 | −0.48 | 5.60 | 26.7 | 105 | 486 |
| | 85.2 (81.2) | 97.03 | −0.67 | 5.35 | 26.5 | 159 | 2739 |
| | 86.6 (82.4) | 97.33 | −0.64 | 4.65 | 25.7 | 218 | 1772 |
| $D(zE_{o+p})D$ | 78.3 (74.0) | 96.00 | −0.87 | 9.16 | 21.6 | 443 | 1964 |
| | 80.2 (75.8) | 96.25 | −0.91 | 8.05 | 24.4 | 526 | 4557 |
| | 82.9 (79.0) | 96.98 | −0.81 | 6.36 | 21.1 | 271 | 1245 |
| | 83.5 (79.6) | 96.72 | −0.88 | 6.50 | 24.9 | 190 | 1692 |
| | 84.8 (80.8) | 96.50 | −0.32 | 5.30 | 20.7 | 90 | 780 |
| | 84.9 (81.4) | 96.09 | −0.20 | 5.17 | 22.7 | 80 | 1182 |
| | 85.5 (82.1) | 97.40 | −0.82 | 4.92 | 23.8 | 229 | 2658 |
| | 86.2 (82.8) | 97.55 | −0.83 | 4.87 | 23.1 | 62 | 1228 |
| | 87.1 (84.3) | 97.52 | −0.78 | 4.40 | 20.5 | 47 | 1006 |

TABLE III

CHLORINATED PHENOLICS IN THE BLEACHING EFFLUENT

| COMPOUND, ppb | D → CdEo + PD | D(zEo + p)D |
|---|---|---|
| 2,4-DICHLOROPHENOL | 59 | 8 |
| 2,4,6-TRICHLOROPHENOL | 111 | <1 |
| TETRACHLOROPHENOL | <1 | <1 |
| DICHLOROGUAIACOL | 32 | 48 |
| DICHLOROGUAIACOL | 179 | <1 |
| 3,5-DICHLORO-4-HYDROXYBENZALDEHYDE | <1 | <1 |
| 4,5-DICHLOROGUAIACOL | 201 | 5 |
| 2,3,4,6-TETRACHLOROPHENOL | 4 | <1 |
| CHLOROVANILLIN | 20 | <1 |
| 6-CHLOROVANILLIN | 355 | 94 |

TABLE III-continued

| CHLORINATED PHENOLICS IN THE BLEACHING EFFLUENT | | |
|---|---|---|
| COMPOUND, ppb | D → CdEo + PD | D(zEo + p)D |
| DICHLOROCATECHOL | 48 | <1 |
| 4,5-DICHLOROCATECHOL | 55 | 2 |
| 3,4,5-TRICHLOROGUAIACOL | 171 | <1 |
| CHLOROVANILLIN | 47 | 2 |
| DICHLOROVANILLIN | 34 | 5 |
| 4,5,6-TRICHLOROGUAIACOL | 21 | <1 |
| 5,6-DICHLOROVANILLIN | 74 | 2 |
| 2-CHLOROSYRINGEALDEHYDE | 3 | <2 |
| 3,4,5-TRICHLOROCATECHOL | 207 | 3 |
| 3,4,5,6-TETRACHLOROGUAIACOL | 18 | <1 |
| 3,4,5-TRICHLORO-2,6-DIMETHOXYPHENOL | 2 | 3 |
| TETRACHLOROCATECHOL | 32 | 1 |
| 2,6-DICHLORSYRINGEALDEHYDE | 11 | <1 |

The present process was also tested in comparison to a "control" process in which all material parameters of the processes were identical except in the control process no ozone was employed. The test pulp was southern pine softwood kraft pulp of Kappa No. 27.3 and a viscosity of 27 cP. There was no washing between the steps of adding the ozone and the extraction stage of the present process. The test conditions and the results of testing of the resultant pulps are given in Table IV.

TABLE IV

| COMPARISON OF DEo + pD AND D(zEo + p)D BLEACHING PROCESSES | | | | |
|---|---|---|---|---|
| | D(zEo + p)D | | DEo + pD | |
| D Stage | 1.88% $ClO_2$<br>10% csc,<br>45° C., 30 min. | | Same | |
| P. No | 8.2 | | | |
| z | 0.24% ozone<br>pH = 2 | | no | |
| P. No | 6.5 | | | |
| Eo + p stage | 1.5% NaOH<br>0.6% $H_2O_2$<br>10% csc<br>85° C., 1 hr | | Same | |
| P. No | 1.7 | | 2.3 | |
| Brightness (% GE) | 68.0 | | 60.0 | |
| D stage | | | | |
| $ClO_2$ (%) | 0.5 | 0.8 | 0.5 | 0.8 |
| end pH | 4.1 | 3.4 | 4.0 | 3.7 |
| Brightness (% GE) | 85.5<br>(81.7) | 86.3<br>(82.9) | 82.3<br>(79.5) | 85.2<br>(81.8) |
| Viscosity (cP) | 19.4 | 19.0 | 23.4 | 21.7 |
| TOCl (ppm) | 165 | 150 | 220 | 190 |

Remarks:
(1) Texarkana softwood pulp, kappa number = 27.3, viscosity = 27 cP.
(2) No washing between z and Eo + p.

It will be noted from Table IV that two runs were made employing the two processes with the only operational difference between the two runs being an increase in chlorine dioxide added in the final bleaching stage. In the first run, 0.5% chlorine dioxide was used with each process and in the second run 0.8% chlorine dioxide was used. The major significant results of these tests were that (1) to obtain equivalent final brightness of the two pulps, the control process required the use of about 35% more chlorine dioxide in the final bleaching stage, and (2) the present process produced significantly lower total organic chlorides (TOCL) in the pulp (165 ppm versus 190 ppm at equivalent brightness values).

I claim:

1. A method of bleaching a cellulosic kraft papermaking pulp in a multi-stage bleaching flow stream sequence using chlorine-containing bleaching agents in the first and final stages, said method comprising the steps of adjusting the O.D. weight consistency of an acidic pulp flow stream from said first bleach stage to a range of within about 25% to 35% and adjusting the temperature thereof to a range of about 20° to 60° C., combining said consistency and temperature adjusted pulp flow stream in a first mixer with a gaseous flow mixture of ozone and oxygen pressurized to a range of about 60 psi. to about 100 psi. wherein the ozone volume constituency of said gaseous flow mixture is about 5% to about 10% of the gaseous mixture volume and the ozone weight flow rate is about 0.2% to about 0.5% of the O.D. pulp weight flow rate, said temperature of the pulp in said first mixer being not sufficiently high as to permit the oxygen in the ozone mixture to react with components of the pulp, providing a residence time between said first mixer and a second mixer sufficient to substantially complete a chemically reactive consumption of said ozone by said pulp prior to said second mixer, following completion of said ozone consumption, adjusting the O.D. weight consistency, temperature and pH conditions of said pulp flow stream to initiate an extended reaction of said oxygen with said flow stream pulp, and, following said extended oxygen reaction, combining with said pulp flow stream, a final stage chlorine containing bleaching agent.

2. The method of claim 1 wherein a peroxide compound is combined with said pulp flow stream for extended reaction with said pulp flow stream substantially simultaneously with said oxygen.

3. The method of claim 1 wherein additional oxygen is added to said pulp flow stream for extended reaction therewith.

4. The method of claim 1 wherein caustic is combined with said pulp flow stream by said second mixer.

5. The method of claim 4 wherein excessive oxygen is released from said pulp flow stream prior to said extended oxygen reaction condition adjustments.

6. The method of claims 1 wherein said pulp flow stream temperature is raised to about 70° C. following consumption of said ozone.

7. The method of claim 1 wherein said pulp flow stream O.D. weight consistency is reduced to less than about 10% following consumption of said ozone.

8. The method of claim 1 wherein said chlorine containing bleaching agents comprise chlorine dioxide.

9. The method of claim 1 wherein said pulp flow stream is washed between said extended oxygen reaction and said final stage bleaching agent.

10. In a multi-stage bleaching sequence for enhancing the brightness of a kraft cellulosic pulp, said bleaching sequence employing a chlorine-containing bleaching agent in the first and final states thereof and an intermediate alkaline extraction stage in which the pH of the pulp is adjusted to an alkaline state, the improvement comprising, following said first stage and before said extraction stage, adjusting said pulp to an O.D. pulp weight consistency of between about 25% and about 35%, mixing said pulp of adjusted consistency, at a temperature of between about 20° C. and about 60° C., with a gaseous mixture of ozone and oxygen at a pressure of between about 60 and about 100 psig in a first mixer, wherein the ozone constituent represents about 5% to 10% of the gaseous mixture volume and the quantity of ozone presented to said pulp is between about 0.2% and about 0.4% ozone, based on oven dried pulp weight, for reaction of said ozone with said pulp substantially exclusive of said oxygen before a second mixer, the temperature of said pulp being insufficient to promote reaction of oxygen in the gaseous mixture with said pulp, adjusting the pulp consistency, temperature and pH to initiate reaction of said oxygen with said pulp in the second mixer, and thereafter processing said ozone and oxygen treated pulp through said extraction stage and said final stage.

11. The improvement of claim 10 and including the addition of peroxide to said pulp in said extraction stage.

12. The improvement of claim 10 wherein said pulp stream is off-gassed following the reaction of said ozone with said pulp to reduce the quantity of oxygen present in said pulp.

13. The improvement of claim 10 wherein the step of addition of said ozone to said pulp is divided between two mixers.

14. The improvement of claim 13 wherein the pH of said pulp is adjusted to an alkaline state by the addition of caustic at a sequentially latter of said two mixers.

15. The improvement of claim 10 wherein the consistency, temperature and pH conditions of said pulp are adjusted to initiate an extended reaction of oxygen with said pulp upon completion of said ozone reaction.

16. The improvement of claim 15 wherein the temperature of said pulp is adjusted to about 70° C. upon completion of said ozone reaction.

17. The improvement of claim 10 wherein said first and final stage bleaching agents comprise chlorine dioxide.

18. The improvement of claim 10 wherein said ozone and oxygen treated pulp is washed between said extraction stage and said final stage.

* * * * *

UNITED STATES PATENT AND TRADEMARK OFFICE

CERTIFICATE OF CORRECTION

PATENT NO. : 5,389,201

DATED : Feb. 14, 1995

INVENTOR(S) : Ted Y. Tsai

It is certified that error appears in the above-indentified patent and that said Letters Patent is hereby corrected as shown below:

Column 8, line 68, after "final" delete "states" and insert --stages--.

Signed and Sealed this

Fourteenth Day of May, 1996

*Attest:*

Bruce Lehman

BRUCE LEHMAN

*Attesting Officer*

*Commissioner of Patents and Trademarks*